United States Patent [19]

Easton et al.

[11] 4,177,989

[45] Dec. 11, 1979

[54] HOLLOW BAT AND METHOD OF MAKING

[75] Inventors: James L. Easton, Los Angeles; Gary W. Filice, Thousand Oaks, both of Calif.

[73] Assignee: James D. Easton, Inc., Van Nuys, Calif.

[21] Appl. No.: 855,320

[22] Filed: Nov. 28, 1977

[51] Int. Cl.[2] ..... A63B 59/06

[52] U.S. Cl. ..... 273/72 A; 29/523

[58] Field of Search ..... 273/72 A, 82 A, 82 B; 220/66, 200

[56] References Cited

U.S. PATENT DOCUMENTS

| | | | |
|---|---|---|---|
| 3,152,711 | 10/1964 | Mumford et al. | 220/66 X |
| 3,927,466 | 12/1975 | Rosalsky | 273/72 AX |

*Primary Examiner*—Richard J. Apley

*Attorney, Agent, or Firm*—Ralph M. Braunstein; Ronald W. Reagin

[57] ABSTRACT

A method of attaching a hollow end knob to the handle portion of a hollow ball bat, in which the hollow bat handle portion positioned within the cavity of the hollow end knob is outwardly deformed to a transverse cross-section substantially larger than the cavity opening. The outward deformation is preferably accomplished by applying pressure against the transverse exterior surface of the end knob which in turn bears against the circular end of the hollow bat handle. The interior transverse surface of the end knob may have a circular recess corresponding to the end of the bat handle.

A hollow metal ball bat having a hollow end knob encompassing an enlarged section of a hollow handle portion. The opening of the end knob is smaller than the contained enlarged handle portion, and fits over the smaller cross-section of the handle portion adjacent the enlarged portion.

2 Claims, 4 Drawing Figures

HOLLOW BAT AND METHOD OF MAKING

BACKGROUND OF THE INVENTION

This invention relates to a method of manufacturing a hollow metal ball bat and to the product resulting from the use of the method. More particularly, it relates to a new and advantageous technique for attaching an end knob to the handle portion of a hollow metal baseball bat.

The familiar form of a baseball bat has a relatively large body portion at one end and a relatively small handle portion at the other end. The handle portion is terminated by a knob or ring-like enlargement which serves to prevent the handle from flying out of the batter's hands as the bat is swung. When baseball bats are turned from wood stock, the end knob is simply formed as an integral enlargement at the bottom of the handle portion. In the case of bats formed of hollow metal, technical and economic limitations of the metal forming process generally dictate that the smoothly tapered bat body and integral handle portion be formed as one unit, while the end knob is formed separately and subsequently affixed to the end of the handle.

In one prior art method of making a metal ball bat, the end knob is formed with a plug or extension adapted to be inserted into the hollow end of the bat handle, which is then crimped to hold the knob in place. This method, disclosed in U.S. Pat. No. 3,735,473 to Wilson, requires elaborate and expensive electrical equipment to generate a pulsed magnetic field which deforms or crimps the metal bat handle.

Another prior art metal bat utilizes a metal end knob formed with an interior cavity adapted to fit over the end of the bat handle portion where it is retained by a circumferential weld. The welding process requires expensive and elaborate electrical apparatus and produces a weld bead at the junction of the knob and handle which may be considered unattractive in sports equipment marketed to the general public.

SUMMARY OF THE INVENTION

The present invention includes a method of permanently and securely affixing an end knob to the handle portion of a hollow bat body made of a deformable material such as metal, particularly aluminum and aluminum alloys which are favored for non-wooden baseball bats. The method comprises, in the preferred embodiments, providing a hollow metal bat body having a generally cylindrical hollow handle portion at one end. While the handle portion is generally cylindrical, it may be flared slightly near the end to provide a somewhat thickened section in the area where the heels of a batter's hands are generally positioned. The end of the handle is open and presents a generally circular transverse cross-section. There is also provided a hollow end knob having an interior cavity with a transverse cross-section substantially larger than that of the end of handle portion of the bat body. The cavity is closed at one end by a transverse wall, and is open at the other end. The cavity opening has a transverse cross-section corresponding to that of the handle end of the bat body so that the handle end may be inserted into the knob cavity with its open end abutting the inside surface of the transverse wall.

In accordance with the invention, the knob is positioned over the end of the handle portion of the bat body with the open end of the handle abutting the inside of the transverse wall of the knob cavity. The end portion of the handle, which is positioned inside the cavity of the end knob, is then deformed outwardly to enlarge its transverse cross-section so that it cannot be pulled out of the cavity. Preferably, the deformation also enlarges the portion of the handle encompassed by the cavity opening so that it engages the sides of the opening and restrains all movement of the knob relative to the bat body.

The product of this method is a hollow ball bat having an end knob firmly secured to its handle portion by the engagement of the rim of the end knob cavity opening with the outer surface of the handle portion and, preferably, by the abuttment of the end of the handle portion against the inner surface of the transverse wall of the knob cavity. This arrangement provides a very effective mechanical joint which resists both longitudinal and circumferential movement of the knob relative to the bat body.

The objects and advantages of the invention will be more fully understood from the following detailed description in conjunction with the accompanying drawing, in which:

DETAILED DESCRIPTION OF THE PREFERRED EMBODIMENTS

Figure 1:
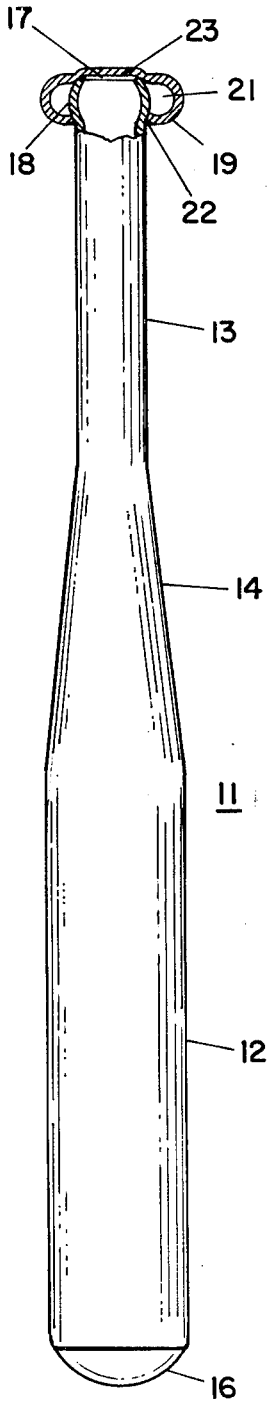
FIG. 1 shows a hollow ball bat manufactured by the method of this invention.

The bat 11 depicted in FIG. 1 is of the familiar shape, comprising a generally cylindrical barrel portion 12 and a generally cylindrical handle portion 13 connected by a tapered section 14. The body of bat 11 is hollow and is made of a deformable material such as, for example, aluminum or an aluminum alloy. The free end of barrel portion 12 is closed by a cap or plug 16 in any convenient manner known to those skilled in this art. All or part of the bat body may be filled with a resiliently compressible material adapted to dampen vibration, absorb shock and lend structural support to the metal "skin."

The open end 17 of handle portion 13 has an enlarged section 18 near its opening. A hollow end knob 19 is secured to the end of handle 13. Knob 19 has an interior cavity 21 with a transverse cross-section substantially larger than that of handle 13 and an opening 22 corresponding closely to the cross-section of the unenlarged section of handle 13. The depth of cavity 21 is sufficient that the knob 19 is adapted to fit over the end of handle 13 with the edge of opening 22 engaging the surface of the unenlarged section of the handle, while the enlarged section 18 is contained within cavity 21. Cavity 21 is closed by a transverse wall 23. Preferably, the end 17 of handle 13 abuts the inner surface of wall 23, which may be formed with a depression or trough 24 (see FIG. 2) adapted to receive the edge of end 17.

Figure 2:
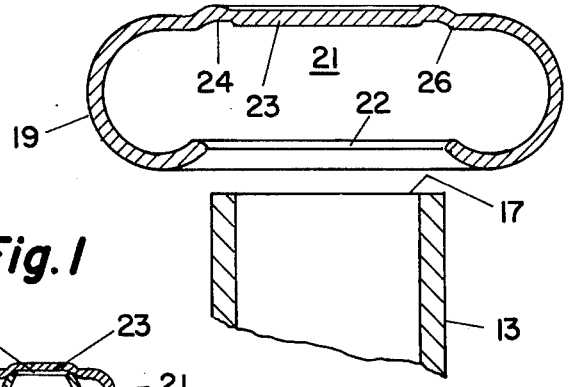
FIGS. 2, 3 and 4 illustrate the sequence of operations performed in manufacturing a hollow ball bat by a preferred embodiment of the method.

The embodiment of the invention shown in FIG. 1 may be formed by a method including the steps of providing a hollow bat body having a generally cylindrical open ended handle portion 13 as illustrated in FIG. 2. There is also provided an end knob 19 having an interior cavity 21 with a transverse cross-section substantially larger than that of handle 13. Cavity 21 has an opening 22 at one end, the opening having a transverse cross-section corresponding to that of handle 13 so that it is adapted to fit closely over the outside of the handle. The other end of cavity 21 is closed by a transverse wall 23, which may include a trough or depression 24 adapted to receive the edge of open end 17 of handle 13. Depression 24 preferably has an outer edge 26 adapted to bear inwardly against the outer edge of end 17 when the handle 13 is in end abutting relation with wall 23.

Figure 3:
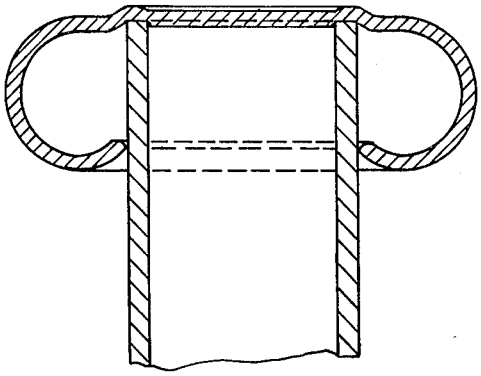

The end 17 of handle 13 is then inserted into the cavity 21 of knob 19 through cavity opening 22 so that it abuts the inner surface of end wall 23, as shown in FIG. 3.

Figure 4:
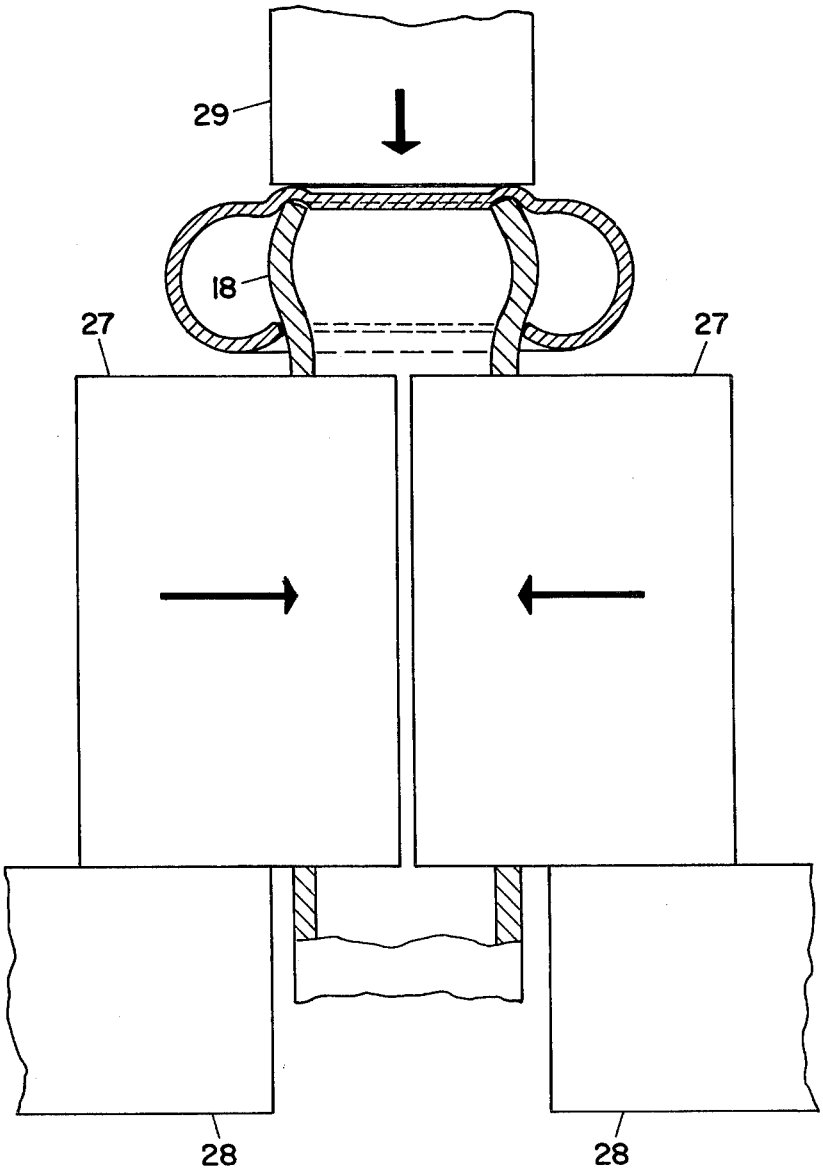

Finally, referring to FIG. 4, handle 13 is gripped just below knob 19 by a pair of encompassing jaws 27 which are supported by a base plate 28, and longitudinal force is applied to the outer surface of transverse end wall 23 by a ram 29, which may be hydraulically activated. The force applied is of a magnitude sufficient to compress axially the end portion of handle 13 which extends above jaws 27 and is largely contained in knob cavity 21. As a result of the compression, the generally cylindrical wall of the end portion 18 of handle 13 is caused to bulge outward, forming a permanently enlarged section inside cavity 21 and having a transverse cross-section larger than that of cavity opening 22. Thus, handle 13 and knob 19 are securely joined by a relatively simple mechanical process which can be performed economically and without the use of elaborate or complex electrical equipment such as that required for welding or electromagnetic forming as previously practiced.

We have found that in the case of baseball bat bodies made of heat treatable aluminum alloy (type 7046-T6, 7005-T6 or type 7178-T6) and having a wall thickness at the handle end in the range of 0.082" to 0.155", a longitudinal force of about 23,000 pounds applied with a 1.250" diameter ram which travels about 0.100" will produce the desired deformation or bulge of the handle end inside the knob. The section of the handle which is to be deformed should be annealed if the bat body has been previously heat treated. Annealling at a temperature of 660° F. for about 90 seconds has been found satisfactory for a wall thickness of 0.153".

Those skilled in the art to which the invention pertains will recognize that many variations and modifications of the invention are possible and may be performed without departing from its scope and spirit which is not limited to the precise forms and steps disclosed by way of illustration and example but by the appended claims.

We claim:

1. A ball bat comprising:

a bat body having a generally cylindrical hollow handle portion open at one end and having an enlarged section therein adjacent the open end, the enlarged section having a circumference which, progressing along the axis of the cylindrical handle portion, first enlarges from the circumference of the remainder of the handle portion and then reduces to a circumference generally equivalent to the circumference of the remainder of the handle portion;

a hollow end knob having an interior cavity of transverse cross-section substantially larger than that of the handle portion of the bat body, the cavity having at one end an opening adapted to fit closely over the handle portion and being closed at the other end by a transverse wall;

the end knob being positioned over the enlarged section of the handle portion of the bat body with the end of the body abutting the transverse wall of the knob and the cavity opening encompassing the handle portion adjacent the enlarged section and pressing tightly thereagainst to provide a mechanical joint which resists both longitudinal and circumferential movement of the knob relative to the bat body.

2. A ball bat as in claim 1 wherein the transverse wall of the end knob has a recess of transverse cross-section corresponding to that of the open end of handle portion of the bat body.

* * * * *